US009307627B2

(12) United States Patent
Kaneko et al.

(10) Patent No.: US 9,307,627 B2
(45) Date of Patent: Apr. 5, 2016

(54) ELECTRON EMITTING DEVICE WITH ELECTRON ACCELERATION LAYER CONTAINING CONDUCTIVE MICROPARTICLES

(71) Applicant: Sharp Kabushiki Kaisha, Osaka-shi, Osaka (JP)

(72) Inventors: Toshihiro Kaneko, Osaka (JP); Tadashi Iwamatsu, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/253,902

(22) Filed: Apr. 16, 2014

(65) Prior Publication Data

US 2014/0312763 A1 Oct. 23, 2014

(30) Foreign Application Priority Data

Apr. 22, 2013 (JP) ..... 2013-089819

(51) Int. Cl.

| | |
|---|---|
| ***H01J 1/88*** | (2006.01) |
| ***H01J 19/42*** | (2006.01) |
| ***F03H 1/00*** | (2006.01) |
| ***H05H 5/02*** | (2006.01) |
| ***H01J 1/312*** | (2006.01) |

(52) U.S. Cl.
CPC . *H05H 5/02* (2013.01); *H01J 1/312* (2013.01)

(58) Field of Classification Search
CPC ..... H05H 5/02; H01J 1/312
USPC ..... 313/491, 497, 500
See application file for complete search history.

(56) References Cited

U.S. PATENT DOCUMENTS

| | | | | |
|---|---|---|---|---|
| 6,791,278 | B2 * | 9/2004 | Russ et al. | 315/169.3 |
| 2002/0053881 | A1 * | 5/2002 | Odake et al. | 315/169.1 |
| 2005/0082964 | A1 * | 4/2005 | Konishi | 313/497 |
| 2007/0210697 | A1 * | 9/2007 | Tamura et al. | 313/496 |
| 2007/0222067 | A1 * | 9/2007 | Nanataki et al. | 257/734 |
| 2010/0278561 | A1 | 11/2010 | Kanda et al. | |
| 2010/0295465 | A1 * | 11/2010 | Hirakawa et al. | 315/287 |
| 2010/0296843 | A1 * | 11/2010 | Hirawaka et al. | 399/168 |

FOREIGN PATENT DOCUMENTS

JP 2009-146891 A 7/2009

* cited by examiner

*Primary Examiner* — Donald Raleigh
(74) *Attorney, Agent, or Firm* — Keating & Bennett, LLP

(57) ABSTRACT

An electron emitting device includes a lower electrode, a surface electrode, an electron acceleration layer between the lower electrode and the surface electrode, and an electrode selecting unit. The electron acceleration layer is made of at least an insulating material. At least one of the lower electrode and the surface electrode is a stripe-pattern electrode including a plurality of unit electrodes that are regularly arranged. The electrode selecting unit sequentially selects, from among the plurality of unit electrodes, a unit electrode to which a voltage is to be applied. A voltage is applied between the lower electrode and the surface electrode to accelerate electrons between the lower electrode and the surface electrode, so that the electrons are emitted from the surface electrode.

3 Claims, 8 Drawing Sheets

ELECTRON EMITTING DEVICE WITH ELECTRON ACCELERATION LAYER CONTAINING CONDUCTIVE MICROPARTICLES

This Nonprovisional application claims priority under 35 U.S.C. §119(a) on Patent Application No. 2013-089819 filed in Japan on Apr. 22, 2013, the entire contents of which are hereby incorporated by reference.

BACKGROUND

1. Field

The present disclosure relates to an electron emitting device that emits electrons in response to an applied voltage.

2. Description of the Related Art

A known example of an electron emitting device is one that utilizes field electron emission. In field electron emission, a voltage is applied between two electrodes to emit electrons. The application of the voltage causes a high electric field to be formed between the electrodes, and thereby electrons are emitted from one of the electrodes (emitter) due to a tunnel effect. Field electron emitting devices of a Spindt type, a carbon nanotube (CNT) type, and so forth, which have different emitter structures, are available.

There has been a demand for use of an electron emitting device in an air atmosphere. However, it is theoretically difficult to operate the above-described electron emitting device that utilizes field electron emission in an air atmosphere. The reason is as follows. A high electric field is necessary to realize field electron emission, and emitted electrons have high energy. If high-energy electrons collide with gas molecules in the air, the gas molecules are ionized. Positive ions produced by the ionization are accelerated, toward the surface of the device, by a high electric field formed near the device, collide with the device, and cause sputtering. The sputtering may break the electron emitting device. Further, in a case where high-energy electrons collide with oxygen molecules, ionization does not occur but ozone is produced. Ozone is very active, is harmful, and deteriorates various substances.

For the above-described reason, an electron emitting device that utilizes field electron emission is generally used while being sealed in a vacuum. In a case where electrons are to be taken from the vacuum, an electron transmission window that separates a vacuum layer and an air atmosphere from each other is set, and the electrons are transmitted from the vacuum layer into the air.

As other types of electron emitting devices, electron emitting devices of a metal insulator metal (MIM) type and a metal insulator semiconductor (MIS) type are available.

These are electron emitting devices of a surface emission type that accelerate electrons by utilizing a quantum size effect and an intense electric field inside the devices and emit the electrons from plane surfaces of the devices. These devices emit electrons that have been accelerated in an electron acceleration layer inside the devices, and thus it is not necessary to form an intense electric field outside the devices. Therefore, electron emitting devices of an MIM type and an MIS type may overcome disadvantages that electron emitting devices of a Spindt type, a CNT type, and a BN type may have, such as breakdown due to sputtering caused by ionization of gas molecules, and production of ozone.

Japanese Unexamined Patent Application Publication No. 2009-146891 (published on Jul. 2, 2009) discloses an electron emitting device including metal microparticles and insulating microparticles that have antioxidant properties. The electron emitting device described in the publication is capable of stably emitting electrons in an air atmosphere as well as in a vacuum, and does not produce harmful substances, such as ozone and NOx.

Regarding the above-described electron emitting devices of an MIM type and an MIS type, there is a need for increasing the size of the device so as to increase the area of a region from which electrons may be emitted. However, in the electron emitting devices of an MIM type and an MIS type according to the related art, it is difficult to evenly emit electrons from the devices if the area of the region from which electrons may be emitted is increased. This will be described below with reference to FIGS. 8A and 8B.

FIGS. 8A and 8B are diagrams illustrating a schematic configuration of an electron emitting device 110, which is a typical MIM-type electron emitting device according to the related art. FIG. 8A is a cross-sectional view, and FIG. 8B is a top view. The electron emitting device 110 includes a lower electrode 102, a surface electrode 103, and an electron acceleration layer 104. The electron acceleration layer 104 includes insulating microparticles and conductive microparticles that are dispersed among the insulating microparticles.

The easiness of emission of electrons in the electron emitting device 110 depends on many parameters, such as the thickness of the electron acceleration layer 104, the distribution of the conductive microparticles dispersed in the electron acceleration layer 104, and the thickness of the surface electrode 103. These parameters spatially vary to some extent in the process of manufacturing the electron emitting device 110. Spatial unevenness of the easiness of emission of electrons in the electron emitting device 110 occurs, in short, as a result of multiplying the variations of the above-mentioned parameters. FIG. 8B is a top view illustrating the electron emitting device 110 in a case where the easiness of emission of electrons is spatially uneven. The electron acceleration layer 104 is not illustrated in FIG. 8B. The surface electrode 103, which is a surface for emitting electrons in the electron emitting device 110, includes regions R1 and R2 from which electrons are easily emitted, and a region R3 from which electrons are not easily emitted. Thus, if a voltage is applied to the lower electrode 102 and the surface electrode 103 by a power supply 120, electrons are easily emitted from the regions R1 and R2. On the other hand, the amount of electrons emitted from the region R3 is smaller than that emitted from the regions R1 and R2.

In this way, the electron emitting device 110 includes regions from which electrons are easily emitted and a region from which electrons are not easily emitted, and accordingly the distribution of electrons emitted by the electron emitting device 110 is spatially uneven. The distribution of emitted electrons becomes more uneven as the area of an electron emission region of the electron emitting device 110 increases.

SUMMARY

Accordingly, the present disclosure provides an electron emitting device that is capable of emitting electrons with high in-plane evenness even if the electron emitting device has a large area.

According to an aspect of the present disclosure, there is provided an electron emitting device including a lower electrode, a surface electrode, an electron acceleration layer between the lower electrode and the surface electrode, and an electrode selecting unit. The electron acceleration layer is made of at least an insulating material. At least one of the lower electrode and the surface electrode is a stripe-pattern electrode including a plurality of unit electrodes that are regularly arranged. The electrode selecting unit sequentially selects, from among the plurality of unit electrodes, a unit electrode to which a voltage is to be applied. A voltage is applied between the lower electrode and the surface electrode to accelerate electrons between the lower electrode and the surface electrode, so that the electrons are emitted from the surface electrode.

BRIEF DESCRIPTION OF THE DRAWINGS

FIGS. 1A and 1B are diagrams illustrating a schematic configuration of an electron emitting device according to a first embodiment of the present disclosure, in which FIG. 1A is a cross-sectional view and FIG. 1B is a top view;

FIGS. 5A and 5B are diagrams illustrating a schematic configuration of an electron emitting device according to a third embodiment of the present disclosure, in which FIG. 5A is a cross-sectional view and FIG. 5B is a top view;

FIGS. 8A and 8B are diagrams illustrating a schematic configuration of an electron emitting device according to the related art, in which FIG. 8A is a cross-sectional view and FIG. 8B is a top view.

DESCRIPTION OF THE EMBODIMENTS

First Embodiment

Figure 1:
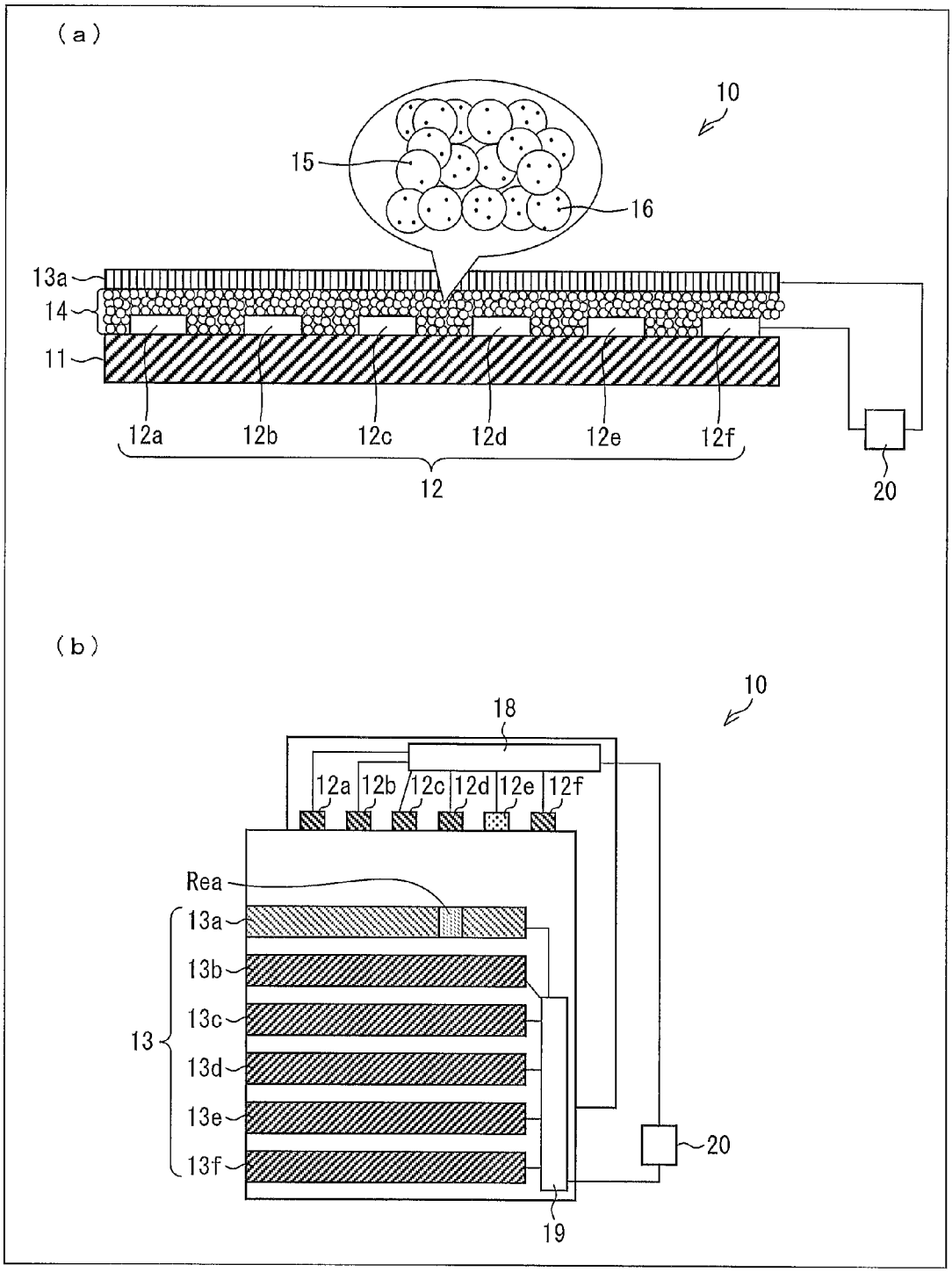

Hereinafter, an electron emitting device 10 according to a first embodiment will be described with reference to FIGS. 1A to 3. The electron emitting device 10 constitutes, together with a power supply 20 serving as a power supply unit, an electron emitting apparatus 1 according to an embodiment of the present disclosure. In the electron emitting device 10, a voltage supplied from the power supply 20 is applied between a lower electrode and a surface electrode to accelerate electrons between the lower electrode and the surface electrode, so that the electrons are emitted from the surface electrode.

Overview of Electron Emitting Device 10

FIGS. 1A and 1B are diagrams illustrating a schematic configuration of the electron emitting device 10. FIG. 1A is a cross-sectional view of the electron emitting device 10, more specifically, is a cross-sectional view taken along a straight line that is parallel to the longitudinal direction of unit electrodes included in a surface electrode 13 and that extends through a unit electrode 13*a*, which is one of the unit electrodes. FIG. 1B is a top view illustrating the configuration of a lower electrode 12 and the surface electrode 13. In FIG. 1B, an electron acceleration layer 14 is not illustrated.

As illustrated in FIGS. 1A and 1B, the electron emitting device 10 includes a substrate 11, the lower electrode 12, the surface electrode 13, the electron acceleration layer 14, a lower-electrode driver 18, and a surface-electrode driver 19. The electron acceleration layer 14 is sandwiched between the lower electrode 12 and the surface electrode 13. As illustrated in FIG. 1A, the electron acceleration layer 14 is formed of a layer filled with insulating microparticles 15, that is, an insulating microparticle layer. In this embodiment, conductive microparticles 16 are dispersed in the electron acceleration layer 14. The electron emitting device 10 having the above-described configuration has a semiconductive electricity transport characteristic.

The power supply 20 is used for supplying a voltage to be applied between the lower electrode 12 and the surface electrode 13. Upon a voltage being applied between the lower electrode 12 and the surface electrode 13, electrons as a bearer of a current flow through the electron acceleration layer 14. At the same time, a high electric field is formed by the applied voltage in the electron acceleration layer 14 sandwiched between the lower electrode 12 and the surface electrode 13. The electrons that flow between the lower electrode 12 and the surface electrode 13 are accelerated by the high electric field, and some of the electrons are emitted as ballistic electrons from the electron acceleration layer 14. The ballistic electrons that have been emitted from the electron acceleration layer 14 tunnel through the surface electrode 13 and are emitted to the outside of the electron emitting device 10.

Substrate 11

The substrate 11 functions as a supporter that supports the electron emitting device 10. The lower electrode 12 is formed on one surface of the substrate 11. Thus, conditions for the substrate 11 include (i) the strength is high to some extent, (ii) the adhesiveness with a substance that is in direct contact is favorable, and (iii) the resistance is high. A substrate to be used as the substrate 11 may be appropriately selected in view of satisfaction of these conditions, easiness of a process, durability, and cost. Specific examples of the substrate 11 include a resin substrate, a glass substrate, and a silicon substrate.

Lower Electrode 12

The lower electrode 12 forms a pair with the surface electrode 13, and forms a high electric field in the electron acceleration layer 14 in response to an applied voltage. As illustrated in FIGS. 1A and 1B, the lower electrode 12 is a stripe-pattern electrode including six unit electrodes 12*a* to 12*f* that are regularly arranged. In this embodiment, the individual unit electrodes 12*a* to 12*f* are rectangular, and are arranged in parallel to one another on the surface of the substrate 11. More specifically, the shapes of the individual unit electrodes 12*a* to 12*f* are rectangular in which the longitudinal direction corresponds to the vertical direction of the top view of the electron emitting device 10 (FIG. 1B). Since the lower electrode 12 is a stripe-pattern electrode including the unit electrodes 12*a* to 12*f*, the unit electrodes 12*a* to 12*f* may be efficiently (without waste) arranged in the electron emitting device 10. Thus, electrons may be emitted from the largest possible region by effectively using the limited area of the electron emitting device 10.

In this embodiment, the lower electrode 12 includes the six unit electrodes 12*a* to 12*f*, but the number of unit electrodes included in the lower electrode 12 is not limited to six. Also, the shapes of the unit electrodes (for example, the aspect ratio of a rectangle) and the interval at which the unit electrodes are arranged are not limited.

The lower electrode 12 may have a favorable conductivity. Specific examples of the material of the lower electrode 12 include metal, such as aluminum, titanium, copper, and stainless, and semiconductor, such as silicon, germanium, and gallium arsenide.

In a case where a stable operation of the electron emitting device 10 in an air atmosphere is demanded, an antioxidant conductor may be used as the material of the lower electrode 12. An example of such a material includes a precious metal. Depending on the application of the electron emitting device 10, an indium tin oxide (ITO) thin film, which is widely used as an oxide conductive material for a transparent electrode, is also useful. From the viewpoint of being able to form a tough thin film, for example, a titanium film with a thickness of 200 nm may be formed on a surface of a glass substrate, and a copper film with a thickness of 1000 nm may be formed thereon, so as to form the lower electrode 12. Note that the material and thickness of the lower electrode 12 are not limited to those described above.

Lower-Electrode Driver 18

The lower-electrode driver 18 is an electrode selecting unit that sequentially selects, from among the six unit electrodes 12*a* to 12*f*, one unit electrode to which a voltage is to be applied. The lower-electrode driver 18 is supplied with a voltage from a positive terminal of the power supply 20. FIG. 1B illustrates a state where the lower-electrode driver 18 selects the unit electrode 12*e* as one unit electrode to which a voltage is to be applied.

Although the details will be described below, the electron emitting device 10 cooperatively controls the lower-electrode driver 18 and the surface-electrode driver 19, thereby sequentially switching a region from which electrons are emitted.

Surface Electrode 13

The surface electrode 13 forms a pair with the lower electrode 12 and applies a voltage into the electron acceleration layer 14. As illustrated in FIGS. 1A and 1B, the surface electrode 13 is a stripe-pattern electrode including six unit electrodes 13*a* to 13*f* that are regularly arranged. In this embodiment, the individual unit electrodes 13*a* to 13*f* are rectangular and are arranged in parallel to one another. More specifically, the shapes of the individual unit electrodes 13*a* to 13*f* are rectangular in which the longitudinal direction corresponds to the horizontal direction of the top view of the electron emitting device 10 (FIG. 1B). Since the surface electrode 13 is a stripe-pattern electrode including the unit electrodes 13*a* to 13*f*, the unit electrodes 13*a* to 13*f* may be efficiently (without waste) arranged in the electron emitting device 10. Thus, electrons may be emitted from the largest possible region by efficiently using the limited area of the electron emitting device 10.

The individual unit electrodes 13*a* to 13*f* included in the surface electrode 13 are arranged so as to cross the individual unit electrodes 12*a* to 12*f* included in the lower electrode 12. More specifically, in this embodiment, the unit electrodes 12*a* to 12*f* included in the lower electrode 12 and the unit electrodes 13*a* to 13*f* included in the surface electrode 13 are orthogonal to each other. In this embodiment, the surface electrode 13 includes the six unit electrodes 13*a* to 13*f*, but the number of unit electrodes included in the surface electrode 13 is not limited to six. Also, the shapes of the unit electrodes (for example, the aspect ratio of a rectangle) and the interval at which the unit electrodes are arranged are not limited.

The material of the surface electrode 13 is not particularly limited as long as the material has a favorable conductivity and is capable of evenly applying a voltage. In a case where the electron emitting device 10 operates in an air atmosphere, gold is the most appropriate material of the surface electrode 13. This is because gold is a metal having a very low reactivity, and there is a very low probability that gold reacts with a substance existing in the air and produces an oxide and a sulfide. Also, silver, palladium, and tungsten that have a relatively low reaction probability of producing an oxide may be used for the surface electrode 13 without a problem.

The electron emission efficiency of the electron emitting device 10 largely depends on the thickness of the surface electrode 13. That is, the thickness of the surface electrode 13 is an important parameter in the electron emitting device 10. To enhance the electron emission efficiency, the thickness of the surface electrode 13 may be in the range from 10 to 55 nm.

In the electron emitting device 10, the minimum thickness of the surface electrode 13 for enabling the surface electrode 13 to function as a plane electrode is 10 nm. If the thickness of the surface electrode 13 is less than 10 nm, it is difficult to ensure the favorable conductivity that is demanded for a plane electrode.

On the other hand, the maximum thickness of the surface electrode 13 that is allowed to enable emission of electrons from the electron emitting device 10 to the outside is 55 nm. If the thickness of the surface electrode 13 is larger than 55 nm, the electron emission efficiency of the electron emitting device 10 decreases because (i) the tunnel probability of ballistic electrons significantly decreases, or (ii) ballistic electrons are reflected by the interface between the surface electrode 13 and the electron acceleration layer 14 and are captured into the electron acceleration layer 14 again. For these reasons, the thickness of the surface electrode 13 may be in the range from 10 to 55 nm.

Surface-Electrode Driver 19

The surface-electrode driver 19 is an electrode selecting unit that sequentially selects, from among the six unit electrodes 13*a* to 13*f*, one unit electrode to which a voltage is to be applied. The surface-electrode driver 19 is supplied with a voltage from a negative terminal of the power supply 20. FIG. 1B illustrates a state where the lower-electrode driver 18 selects the unit electrode 12*e* as one unit electrode to which a voltage is to be applied, and the surface-electrode driver 19 selects the unit electrode 13*a* as one unit electrode to which a voltage is to be applied. That is, only in a region Rea where the unit electrode 12*e* and the unit electrode 13*a* overlap (cross) each other, a high electric field is formed in the electron acceleration layer 14. Thus, electrons are emitted from only the region Rea in the above-described state.

Although the details will be described below, the electron emitting device 10 cooperatively controls the lower-electrode driver 18 and the surface-electrode driver 19, thereby sequentially switching a region from which electrons are emitted.

Electron Acceleration Layer 14

The electron acceleration layer 14 is made of at least an insulating material. The electron acceleration layer 14 may be formed by dispersing conductive microparticles in the insulating material, so as to control the resistance thereof. In this embodiment, the electron acceleration layer 14 is formed of a layer filled with monodisperse insulating microparticles 15 that are arranged, that is, an insulating microparticle layer (see FIG. 1A). The conductive microparticles 16 are dispersed in the electron acceleration layer 14.

As a method for forming the electron acceleration layer 14 including the insulating microparticles 15 and the conductive microparticles 16, the spin coat method may be used, for example. Specifically, a dispersion liquid of the monodisperse insulating microparticles 15 and the conductive microparticles 16 is applied on the substrate 11 and the lower electrode 12, and after that the spin coat method is applied. The dispersion liquid is made by dispersing the monodisperse insulating microparticles 15 and the conductive microparticles 16 in a solvent such as water. The electron acceleration layer 14 formed using the spin coat method may satisfy flatness that is demanded for use as an electron emitting device.

The thickness of the electron acceleration layer 14 may be controlled to be a desired thickness, by appropriately adjusting the concentration of the dispersion liquid, and the number of rotations and rotation time of spin coating. That is, the resistance value of the electron acceleration layer 14 may be easily controlled.

Generally, the surfaces of the substrate 11 and the lower electrode 12 are hydrophobic, and a dispersion liquid containing water as a solvent is hydrophilic. Thus, the surfaces of the substrate 11 and the lower electrode 12 may be processed to be hydrophilic so that the wettability of the dispersion liquid with respect to the substrate 11 and the lower electrode 12 is improved.

As described above, as a result of forming the electron acceleration layer 14 including at least the insulating microparticles 15 using the spin coat method, the electron acceleration layer 14 having a large area may be manufactured with a high throughput and a low cost.

The diameter (average diameter) of the insulating microparticles 15 is preferably 5 to 1000 nm, and is more preferably 15 to 500 nm. Accordingly, the electron acceleration layer 14 is capable of efficiently letting Joule heat escape, the Joule heat being generated when a current flows through the electron acceleration layer 14. Accordingly, breakdown of the electron emitting device 10 caused by heat that is generated when the electron emitting device 10 is driven is suppressed. The resistance value of the electron emitting device 10 (the resistance value between the lower electrode 12 and the surface electrode 13) may be arbitrarily and easily adjusted by changing the thickness of the electron acceleration layer 14, as well as by dispersing the conductive microparticles 16.

The insulating microparticles 15 may be monodisperse, and the diameters thereof may be even. In a case where the electron acceleration layer 14 is formed by filling monodisperse insulating microparticles that are arranged, contacts and continuity paths in the grain boundaries of the insulating microparticles are spatially even. Thus, the electron acceleration layer 14 having the above-described configuration is capable of efficiently transmitting electrons while trapping them, and a large amount of ballistic electrons may be generated immediately under the surface electrode 13. Therefore, with use of the monodisperse insulating microparticles 15, a large amount of electrons may be emitted, and the electron emission efficiency of the electron emitting device 10 may be increased.

As a material of the insulating microparticles 15, silicon oxide, aluminum oxide, or titanium oxide is practically used. An example of a commercially available product is colloidal silica that is manufactured and sold by Nissan Chemical Industries, Ltd.

The thickness of the electron acceleration layer 14 is preferably 8 to 3000 nm, and more preferably 30 to 1000 nm. With this configuration, the surface of the electron acceleration layer 14 may be flattened, and the resistance value of the electron acceleration layer 14 in the thickness direction may be controlled to be within an appropriate range.

Method for Driving Electron Emitting Device 10

Figure 2:
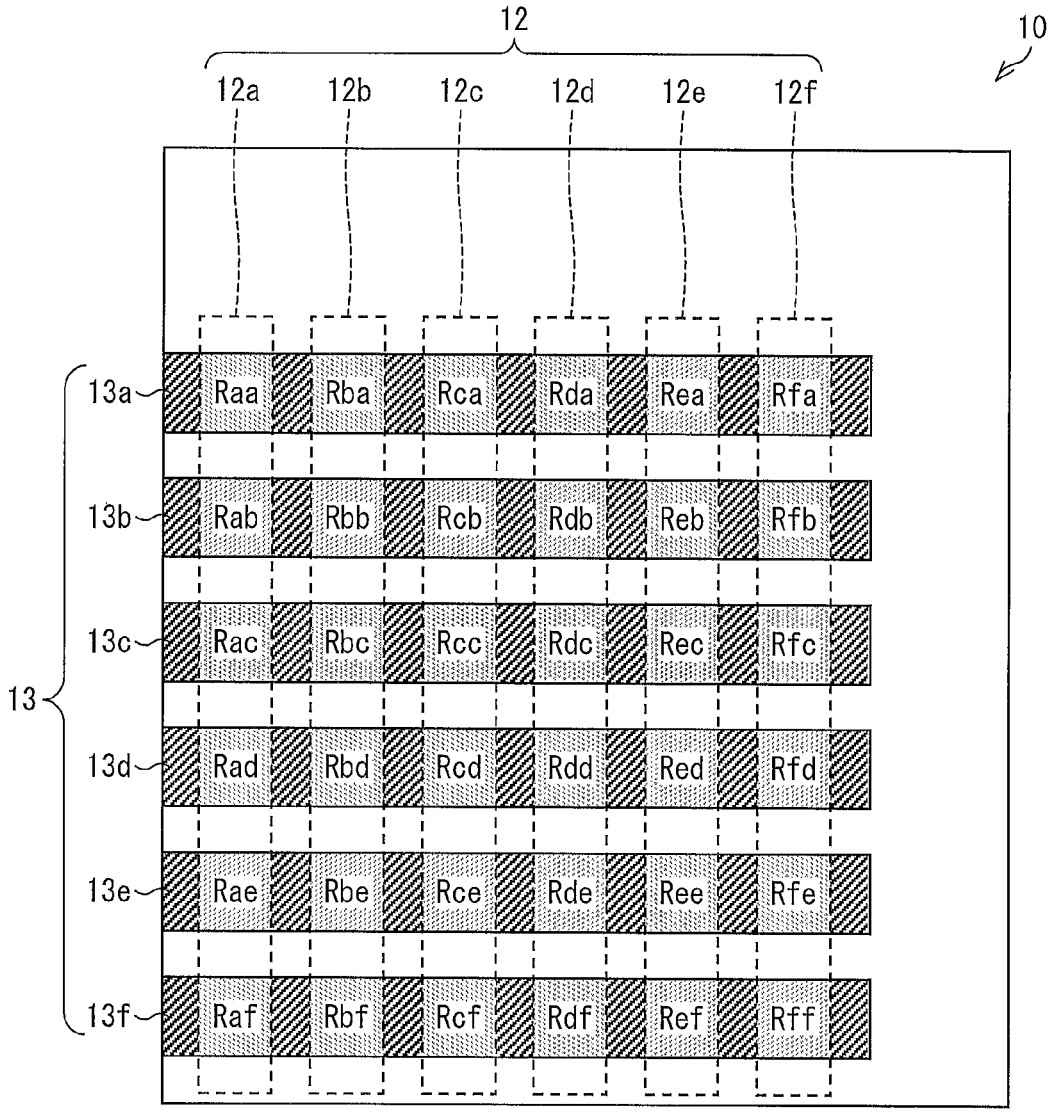
FIG. 2 is a top view illustrating the arrangement of a lower electrode and a surface electrode of the electron emitting device according to the first embodiment of the present disclosure.
Figure 3:
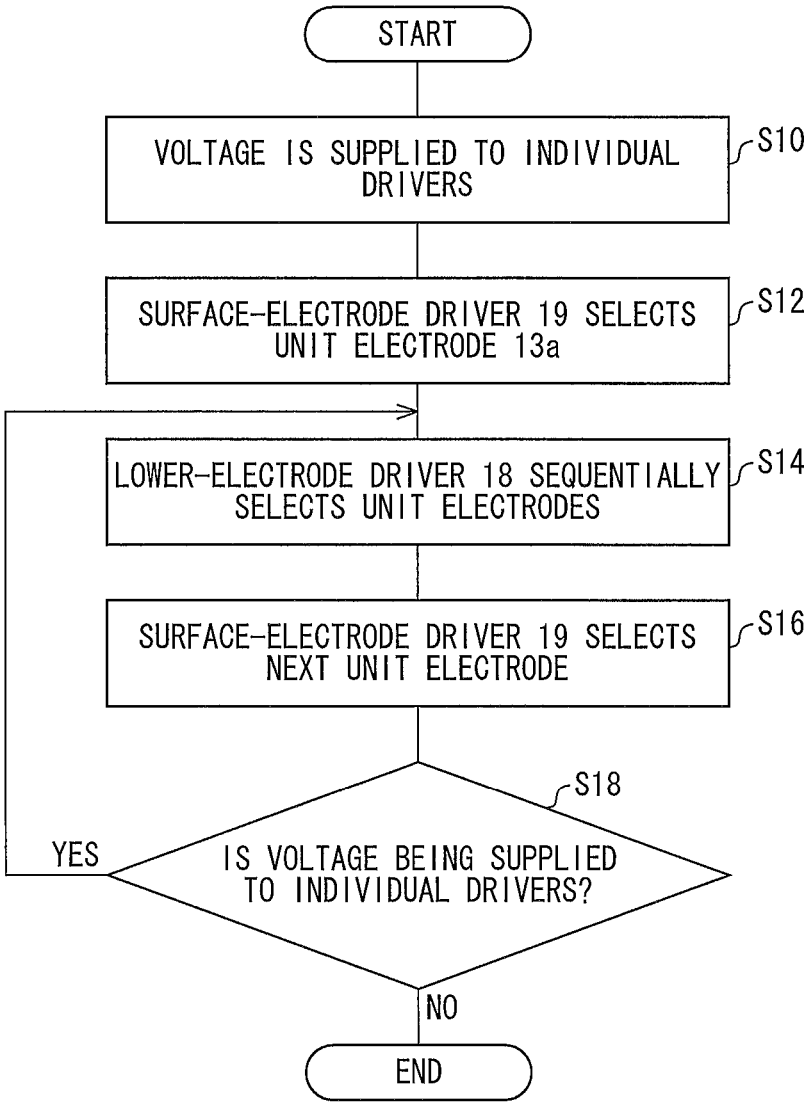
FIG. 3 is a flowchart illustrating a process of driving the electron emitting device according to the first embodiment of the present disclosure.

FIG. 2 is a top view illustrating the arrangement of the unit electrodes 12*a* to 12*f* included in the lower electrode 12 and the unit electrodes 13*a* to 13*f* included in the surface electrode 13 in the electron emitting device 10. Although not illustrated in FIG. 2, the individual unit electrodes 12*a* to 12*f* are connected to the lower-electrode driver 18, and the individual unit electrodes 13*a* to 13*f* are connected to the surface-electrode driver 19. FIG. 3 is a flowchart illustrating a process of driving the electron emitting device 10. Hereinafter, the process of driving the electron emitting device 10 will be described with reference to FIG. 3.

In step S10, a voltage is supplied to the lower-electrode driver 18 and the surface-electrode driver 19 (individual drivers) from the power supply 20.

In step S12, the surface-electrode driver 19 selects the unit electrode 13*a*.

In step S14, the lower-electrode driver 18 sequentially selects the unit electrodes 12*a* to 12*f*, each unit electrode being selected for a certain time period. Here, it is assumed that the certain time period is t milliseconds. When the lower electrode driver 18 selects the unit electrode 12*a*, a voltage is applied to both ends of a region Raa in the electron acceleration layer 14 where the unit electrode 13*a* and the unit electrode 12*a* overlap each other. Accordingly, the electron emitting device 10 emits electrons from the region Raa. No electrons are emitted from the regions other than the region Raa. Subsequently, when the lower-electrode driver 18 selects the unit electrode 12*b* for t milliseconds, the electron emitting device 10 emits electrons from a region Rba. Further, when the lower-electrode driver 18 selects the unit electrode 12*c* for t milliseconds, the electron emitting device 10 emits electrons from a region Rca. In a similar manner, when the lower-electrode driver 18 selects each of the unit electrodes 12*d* to 12*f* for t milliseconds, the electron emitting device 10 emits electrons from a region Rda, a region Rea, and a region Rfa in order.

In step S16, the surface-electrode driver 19 selects the next unit electrode. Specifically, the surface-electrode driver 19 has already selected the unit electrode 13*a*, and thus selects the unit electrode 13*b* as the next unit electrode.

In step S18, the lower-electrode driver 18 and the surface-electrode driver 19 (individual drivers) determine whether or not a voltage is being supplied from the power supply 20. If a voltage is being supplied from the power supply 20 (YES), the process returns to step S14. If a voltage is not being supplied from the power supply 20 (NO), the process of driving the electron emitting device 10 ends.

In step S14, the lower-electrode driver 18 sequentially selects the unit electrodes 12*a* to 12*f*, each unit electrode being selected for t milliseconds. At this time, the surface-electrode driver 19 selects the unit electrode 13*b*, and thus the electron emitting device 10 emits electrons from each of regions Rab, Rbb, Rcb, Rdb, Reb, and Rfb for t milliseconds.

In step S16, the surface-electrode driver 19 selects the next unit electrode. Specifically, the surface-electrode driver 19 has already selected the unit electrode 13*b*, and thus the surface-electrode driver 19 selects the unit electrode 13*c* as the next unit electrode.

In step S18, the lower-electrode driver 18 and the surface-electrode driver 19 determine whether or not a voltage is being applied from the power supply 20. If a voltage is being supplied from the power supply 20 (YES), the process returns to step S14. If a voltage is not being supplied from the power supply 20 (NO), the process of driving the electron emitting device 10 ends.

The following process (the process in which the surface-electrode driver 19 sequentially selects the unit electrodes 13*c* to 13*f*) is the repetition of steps S14 to S18. Thus, the description thereof is omitted.

As described above, the lower-electrode driver 18 sequentially selects, from among the unit electrodes 12*a* to 12*f*, a unit electrode to which a voltage is to be applied, and the surface-electrode driver 19 sequentially selects, from among the unit electrodes 13*a* to 13*f*, a unit electrode to which a voltage is to be applied, and accordingly the electron emitting device 10 sequentially changes a region from which electrons are emitted, from the region Raa to a region Rff. In other words, the electron emitting device 10 divides a time period corresponding to one cycle over which a target region is changed from the region Raa through the region Rff (36×t milliseconds) into sections the number of which corresponds to the number of regions included in the electron emitting device 10 (in this embodiment, 36). Then, the electron emitting device 10 sequentially emits electrons from each of the regions Raa to Rff for the time period corresponding to the section (t milliseconds).

In this embodiment, the surface-electrode driver 19 selects any one of the unit electrodes 13*a* to 13*f* in step S12, and the lower-electrode driver 18 sequentially selects the unit electrodes 12*a* to 12*f*, each unit electrode being selected for t milliseconds, in step S14. However, the process of selecting each of regions Raa to Rff is not limited to the above-described process. For example, the lower-electrode driver 18 may select any one of the unit electrodes 12*a* to 12*f* in step S12, and the surface-electrode driver 19 may sequentially select the unit electrodes 13*a* to 13*f*, each unit electrode being selected for t milliseconds, in step S14. The electron emitting device 10 may have a configuration in which the lower-electrode driver 18 sequentially selects the unit electrodes 12*a* to 12*f* and the surface-electrode driver 19 sequentially selects the unit electrodes 13*a* to 13*f* so that electrons are emitted from each of the regions Raa to Rff for an equal time period, within the time period corresponding to one cycle.

Advantages of Electron Emitting Device 10

As described above, the electron emitting device 10 emits electrons from each of the regions Raa to Rff for an equal time period. That is, the region from which electrons are emitted is changed at a certain time interval in accordance with the unit electrodes selected by the lower-electrode driver 18 and the surface-electrode driver 19.

It is assumed that, in the electron emitting device 10, parameters such as the thickness of the electron acceleration layer 14, the distribution of the conductive microparticles 16 dispersed in the electron acceleration layer 14, and the thickness of the surface electrode 13 vary, and as a result, the easiness of emission of electrons spatially varies. Even in such a case where the easiness of emission of electrons spatially varies, the electron emitting device 10 sequentially changes a region from which electrons are emitted from the region Raa through the region Rff in a time division manner, and thereby emits electrons from each region. That is, the electron emitting device 10 is configured to emit electrons from each of the regions for an equal time period regardless of whether the region is a region from which electrons are easily emitted or a region from which electrons are not easily emitted.

The width of each unit electrode included in the lower electrode 12 and the width of each unit electrode included in the surface electrode 13 may be set independently of the size (area) of the electron emitting device 10. In other words, the area of each of the regions (Raa to Rff) from which electrons are emitted in a period may be determined independently of increasing the area of the electron emitting device 10.

Thus, the electron emitting device 10 does not emit a large amount of electrons from a certain region from which electrons are easily emitted. Even if the area of the electron emitting device 10 is increased, electrons of an even distribution may be emitted over a time period corresponding to one cycle. That is, the electron emitting device 10 is capable of emitting electrons with high in-plane evenness even if the electron emitting device 10 has a large area.

In the electron emitting device 10, compared to an electron emitting device 30 described below, the area of the regions (Raa to Rff) from which electrons are emitted in one cycle may be small. Thus, the electron emitting device 10 may increase in-plane evenness of emitted electrons.

Second Embodiment

Figure 4:
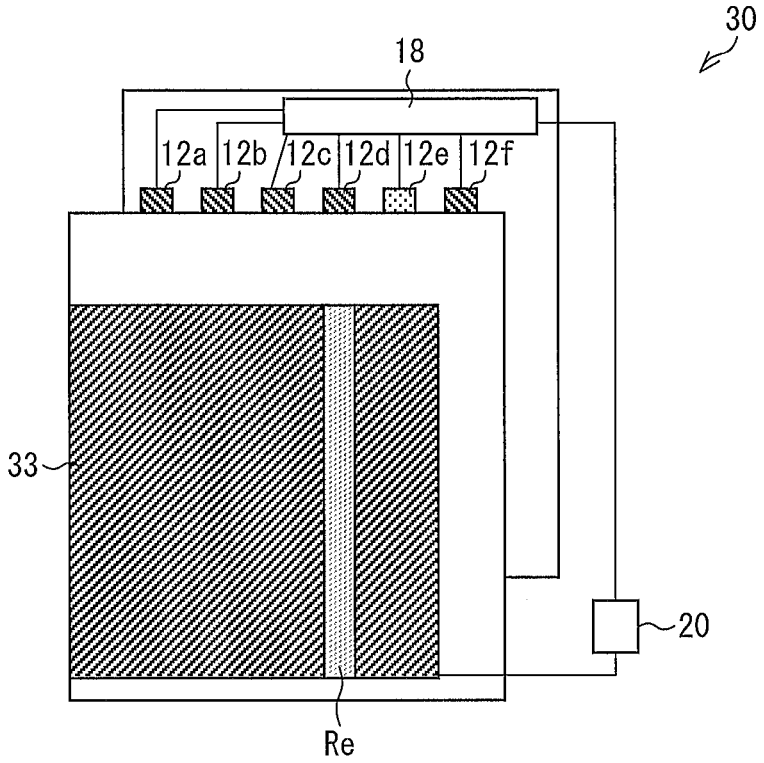
FIG. 4 is a top view illustrating a schematic configuration of an electron emitting device according to a second embodiment of the present disclosure.

Hereinafter, the electron emitting device 30 according to a second embodiment will be described with reference to FIG. 4. For the convenience of description, the parts having the same functions as those described in the first embodiment are denoted by the same reference numerals, and the corresponding description is omitted. FIG. 4 is a top view illustrating a schematic configuration of the electron emitting device 30.

As illustrated in FIG. 4, the electron emitting device 30 is different from the electron emitting device 10 according to the first embodiment in that a single surface electrode 33 that does not include unit electrodes is provided. The surface electrode 33 is configured to cover the lower electrode 12.

When the electron emitting device 30 is driven, a voltage is constantly applied to the surface electrode 33 from the power supply 20. On the other hand, the lower-electrode driver 18 sequentially selects, from among the six unit electrodes 12*a* to 12*f*, one unit electrode to which a voltage is to be applied. The electron emitting device 30 applies a voltage between the unit electrode selected by the lower-electrode driver 18 and the surface electrode 33 so as to accelerate electrons, and emits the electrons from a region that faces the selected unit electrode in the surface electrode 33.

For example, FIG. 4 illustrates a state where the lower-electrode driver 18 selects the unit electrode 12*e* as a unit electrode to which a voltage is to be applied. In this state, the electron emitting device 30 emits electrons from a region Re that faces the unit electrode 12*e*. When the lower-electrode driver 18 selects the unit electrode 12*f* as a unit electrode to which a voltage is to be applied, the electron emitting device 30 emits electrons from a region that faces the unit electrode 12*f* in the surface electrode 33. The same applies to a case where the lower-electrode driver 18 selects each of the unit electrodes 12*a* to 12*d* as a unit electrode to which a voltage is to be applied.

As described above, a region from which electrons are emitted at the same time in the electron emitting device 30 is only a region, in the surface electrode 33, that faces a unit electrode selected by the lower-electrode driver 18. Thus, the electron emitting device 30 does not emit a large amount of electrons from a certain region from which electrons are easily emitted. Even if the area of the electron emitting device 30 is increased, electrons of an even distribution may be emitted over a time period corresponding to one cycle. That is, the electron emitting device 30 is capable of emitting electrons of an even distribution even if the electron emitting device 30 has a large area.

The surface electrode 33 is formed of a single electrode, not a plurality of unit electrodes. Thus, the electron emitting device 30 need not include a surface-electrode driver. That is, the electron emitting device 30 has a simpler configuration than the electron emitting device 10. Thus, the manufacturing process of the electron emitting device 30 is simpler than that of the electron emitting device 10, and as a result, an increase in manufacturing cost may be suppressed and yields may be increased.

In the electron emitting device 30 according to this embodiment, the lower electrode among the lower electrode and the surface electrode includes a plurality of unit electrodes that are regularly arranged. However, in the electron emitting device 30 according to this embodiment, at least one of the lower electrode and the surface electrode may include a plurality of unit electrodes that are regularly arranged. That is, the electron emitting device according to this embodiment may be configured to include a lower electrode including a single electrode, and a surface electrode including a plurality of unit electrodes that are regularly arranged.

Third Embodiment

Figure 5:
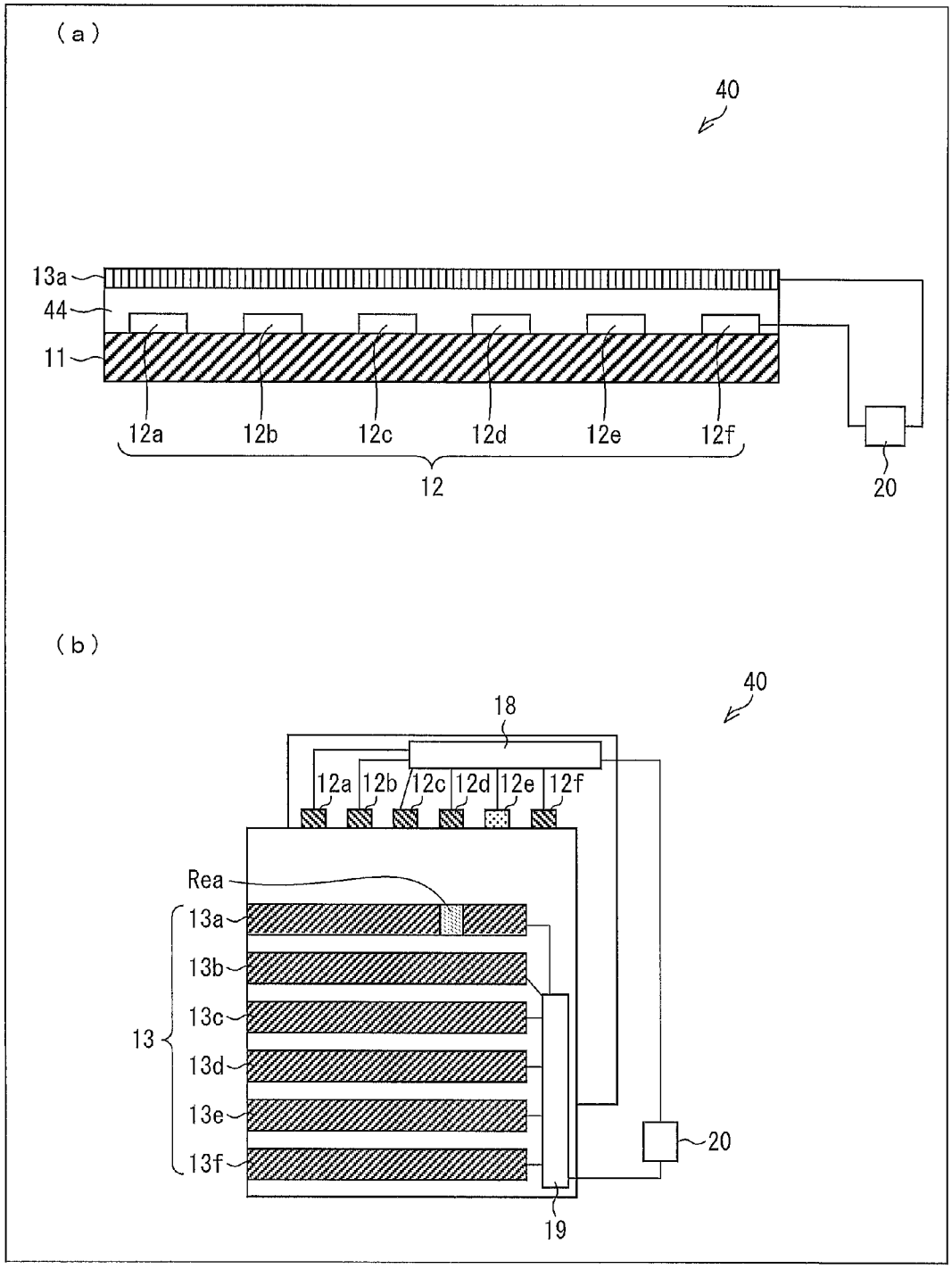

Hereinafter, an electron emitting device 40 according to a third embodiment will be described with reference to FIGS. 5A and 5B. For the convenience of description, the parts having the same functions as those described in the first embodiment are denoted by the same reference numerals, and the corresponding description is omitted. FIGS. 5A and 5B are diagrams illustrating a schematic configuration of the electron emitting device 40, in which FIG. 5A is a cross-sectional view and FIG. 5B is a top view.

As illustrated in FIG. 5A, the electron emitting device 40 is different from the electron emitting device 10 according to the first embodiment in that an electron acceleration layer 44 made of a resin containing conductive microparticles (not illustrated) is provided. As illustrated in FIG. 5B, the electron emitting device 40 includes the lower electrode 12 including the unit electrodes 12*a* to 12*f* and the surface electrode 13 including the unit electrodes 13*a* to 13*f*. The configurations of the lower electrode 12 and the surface electrode 13 are the same as those in the electron emitting device 10.

FIG. 5B illustrates a state where the lower-electrode driver 18 selects the unit electrode 12*e* and the surface-electrode driver 19 selects the unit electrode 13*a*. In this state, the electron emitting device 40 emits electrons from a region Rea in which the unit electrode 12*e* and the unit electrode 13*a* overlap each other. In this way, the electron emitting device 40 is driven in a similar manner to the electron emitting device 10.

An electron acceleration layer included in an electron emitting device according to an embodiment of the present disclosure may be made of at least an insulating material, and may be made of a resin containing conductive microparticles, as described above. According to the above-described configuration, the in-plane evenness of electrons emitted by the electron emitting device may be further increased.

Generally, insulating microparticles tend to flocculate as the particle diameter thereof decreases. Thus, if an electron acceleration layer including insulating microparticles having a small particle diameter is formed, flocculation of the insulating microparticles may occur in the electron acceleration layer, and the thickness of the electron acceleration layer may become uneven. The amount of electrons emitted by an electron emitting device increases as the intensity of an electric field formed in the electron acceleration layer by an applied voltage increases. If the thickness of the electron acceleration layer is uneven, the intensity of the electric field formed in the electron acceleration layer is uneven, and as a result, in-plane evenness of electrons emitted by the electron emitting device decreases. The thickness of the electron acceleration layer may be made more even by forming the electron acceleration layer using a resin containing conductive microparticles. Accordingly, in-plane evenness of electrons emitted by the electron emitting device may be further increased.

Fourth Embodiment

Charging Apparatus 50

Figure 6:
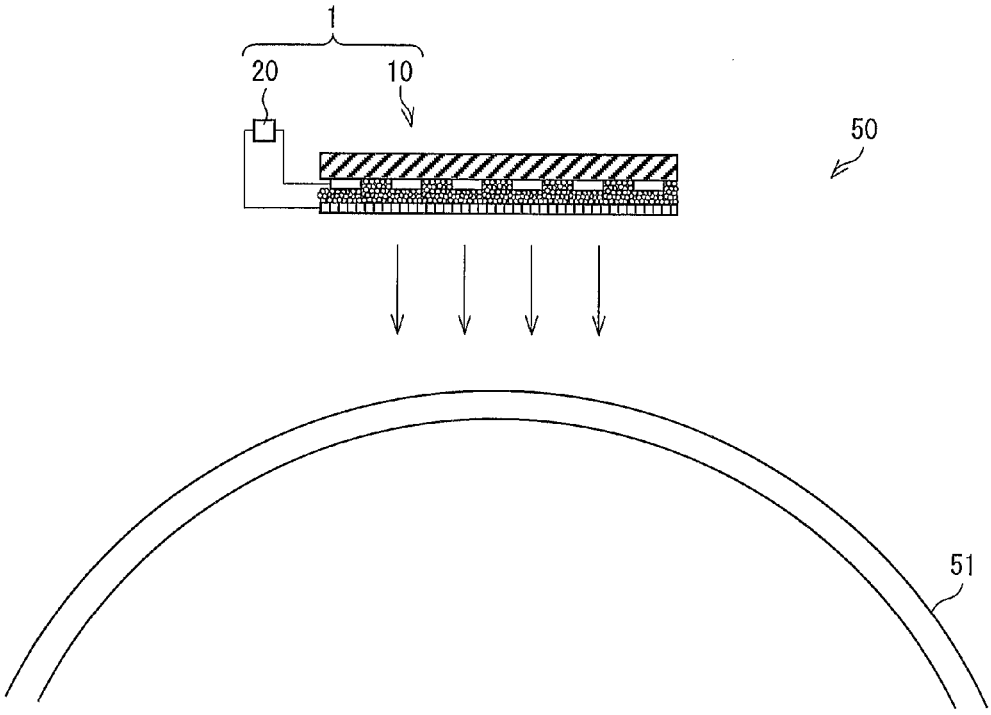
FIG. 6 is a diagram illustrating a schematic configuration of a charging apparatus according to a fourth embodiment of the present disclosure.

FIG. 6 illustrates an example of a charging apparatus including the electron emitting device 10 according to the first embodiment. FIG. 6 is a diagram illustrating a schematic configuration of a charging apparatus 50 according to a fourth embodiment. The charging apparatus 50 includes the electron emitting apparatus 1 including the electron emitting device 10 and the power supply 20 for applying a voltage to the electron emitting device 10, and a photoconductor drum 51. An image forming apparatus according to an embodiment of the present disclosure includes the charging apparatus 50.

In the image forming apparatus according to the embodiment of the present disclosure, the electron emitting device 10 of the charging apparatus 50 is disposed so as to face the photoconductor drum 51, which is an object to be charged. Application of a voltage to the electron emitting device 10 using the power supply 20 causes the electron emitting device 10 to emit electrons, and the emitted electrons cause the surface of the photoconductor drum 51 to be charged. Here, the electron emitting device 10 included in the charging apparatus 50 may be disposed at a distance of, for example, 3 to 5 mm from the surface of the photoconductor drum 51. A voltage applied to the electron emitting device 10 may be about 25 V. The electron acceleration layer 14 of the electron emitting device 10 may be configured to emit electrons of 1 $\mu A/cm^2$ per unit time, for example, when a voltage of 25 V is applied from the power supply 20.

In the image forming apparatus according to the embodiment of the present disclosure, the members other than the charging apparatus 50 may be members according to the related art. The electron emitting device 10 has high electron emission efficiency. Thus, the charging apparatus 50 may efficiently charge the photoconductor drum 51.

The electron emitting device 10 used in the charging apparatus 50 does not form an electric field outside the electron emitting device 10, and thus does not discharge when operating in an air atmosphere. Therefore, the charging apparatus 50 does not produce ozone even if it is used in an air atmosphere. Ozone is harmful to a human body, and is regulated by various standards regarding environment. Thus, the charging apparatus 50 that does not produce ozone may increase the degree of freedom in designing an image forming apparatus.

In the related art, even if a charging apparatus is designed so that ozone is not discharged to the outside of the apparatus, ozone produced in the apparatus may oxidize and deteriorate an organic material of the apparatus, for example, the photoconductor drum 51 and a belt. The disadvantages regarding production of ozone in the above-described image forming apparatus may be overcome by using the electron emitting apparatus 1 including the electron emitting device 10 in the charging apparatus 50.

The electron emitting device 10 included in the charging apparatus 50 is a surface electron emission source that emits two-dimensional electrons from the surface of the device. Thus, the charging apparatus 50 may charge the photoconductor drum 51 over a width in the rotation direction of the photoconductor drum 51. This means that the opportunities of charging a specific portion of the photoconductor drum 51 increase. In this way, the charging apparatus 50 including a surface electron emission source realizes more even charging than a wire charging device that performs charging linearly.

In the case of charging the photoconductor drum 51 using the charging apparatus 50, a voltage to be applied to the electron emitting device 10 is about 25 V. On the other hand, in the case of a wire charging device including a corona discharger, a voltage to be applied to charge a photoconductor drum is several kV. In this way, the charging apparatus 50 including the electron emitting device 10 realizes operation at a very low applied voltage, compared to a wire charging device including a corona discharger.

Fifth Embodiment

Electron Beam Curing Apparatus 60

Figure 7:
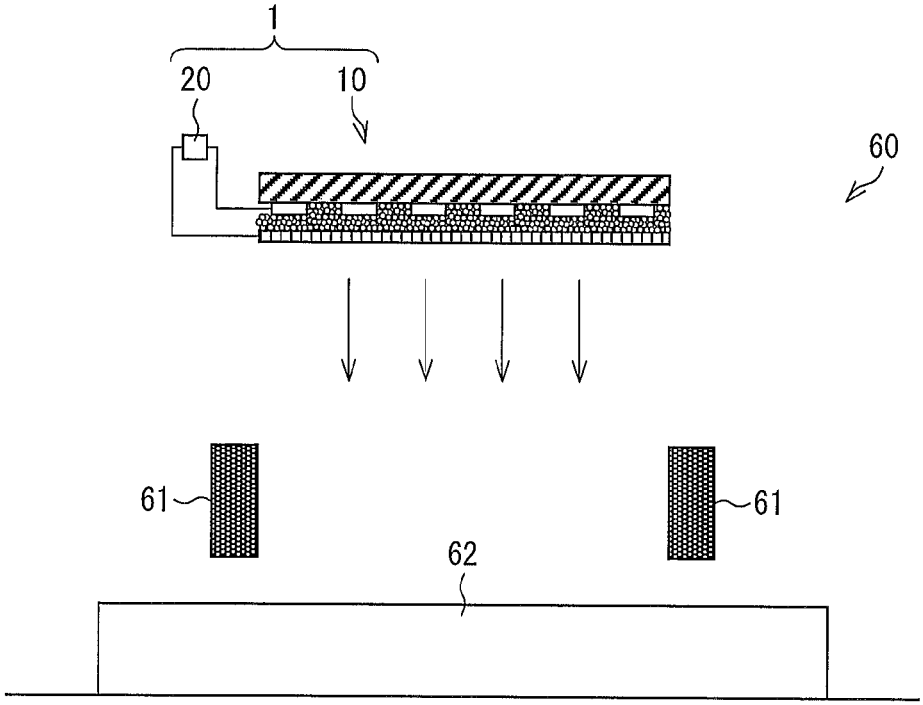
FIG. 7 is a diagram illustrating a schematic configuration of an electron beam curing apparatus according to a fifth embodiment of the present disclosure.
Figure 8:
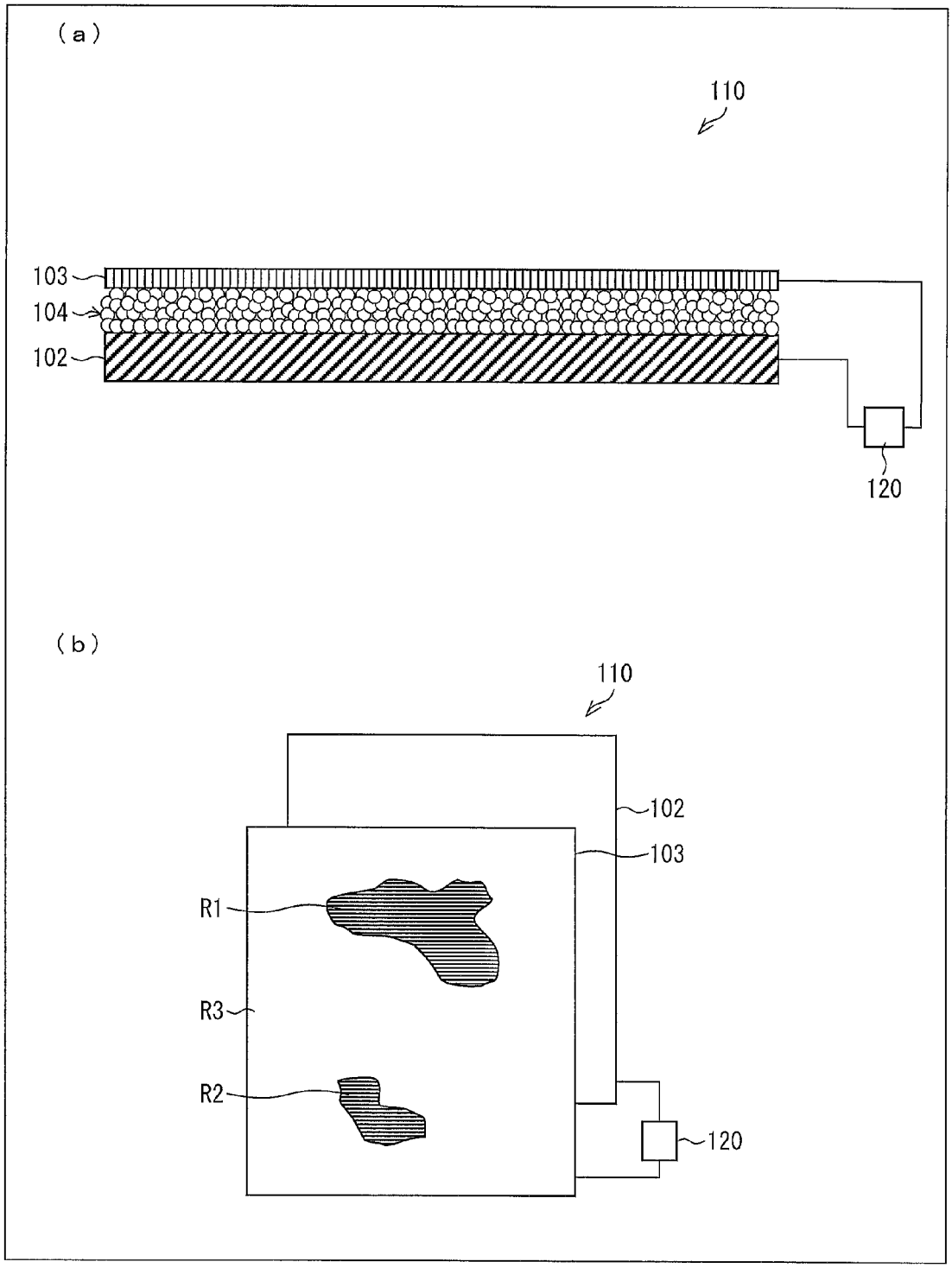

FIG. 7 illustrates an example of an electron beam curing apparatus including the electron emitting device 10 according to the first embodiment. FIG. 7 is a diagram illustrating a schematic configuration of an electron beam curing apparatus 60 according to a fifth embodiment. The electron beam curing apparatus 60 includes the electron emitting apparatus 1 including the electron emitting device 10 and the power supply 20 for applying a voltage thereto, and an acceleration electrode 61 that accelerates emitted electrons.

The electron beam curing apparatus 60 includes the electron emitting device 10 as an electron emission source, and causes the acceleration electrode 61 to accelerate emitted electrons so that the electrons collide with a resist 62. As a result, the resist 62 absorbs energy of an electron beam so as to be cured.

The energy for curing a typical resist is 10 eV or less. The electrons emitted by the electron emitting device 10 have energy of 10 eV or more. Thus, from the viewpoint of simply curing a resist, it is not necessary to further accelerate the electrons. However, the depth of permeation of electrons into a resist depends on the energy of the electrons. For example, to completely cure the resist 62 having a thickness of 1 μm in the thickness direction, an acceleration voltage of about 5 kV is used. In this way, the acceleration electrode 61 is used to give sufficient energy to emitted electrons in accordance with the thickness of the resist 62.

In a typical electron beam curing apparatus according to the related art, an electron emission source is vacuum-sealed, and a high voltage (50 to 100 kV) is applied to the electron emission source, and thereby electrons are emitted. In the case of curing a resist in an air atmosphere, an electron transmission window that separates a vacuum phase and an air phase is used. After the electrons have been transmitted from a vacuum into the air through the electron transmission window, a target is irradiated with the electrons. In the irradiation, large energy is absorbed by the electron transmission window when the emitted electrons pass through the electron transmission window. A field-emission-type device is used as an electron emission source, and thus the electrons that have reached a resist have energy higher than necessary. Thus, many electrons pass through the resist, and the energy usage efficiency for curing the resist decreases. Further, the electron emitting device of a field emission type is a point electron emission source, and thus the range irradiated with electrons at a time is limited to a small range. Thus, the throughput in the case of curing a resist is low.

In contrast, the electron beam curing apparatus 60 including the electron emitting device 10 is capable of operating in an air atmosphere, and the electron emitting device 10 need not be vacuum-sealed. Further, since the electron emitting device 10 has high electron emission efficiency, the electron beam curing apparatus 60 is capable of efficiently emit electron beams. The electrons emitted from the electron emitting device 10 do not pass through the electron transmission window, and thus there is no energy loss. Thus, an acceleration voltage for accelerating emitted electrons may be decreased. Further, since the electron emitting device 10 is a surface electron emission source, the throughput in the case of curing a resist is very high compared to an electron beam curing apparatus according to the related art. If electrons are emitted in accordance with a pattern, maskless exposure may be performed.

Conclusion

An electron emitting device (30) according to a first aspect of the present disclosure includes a lower electrode (12) and a surface electrode (33). A voltage is applied between the lower electrode (12) and the surface electrode (33) to accelerate electrons between the lower electrode (12) and the surface electrode (33), so that the electrons are emitted from the surface electrode (33). An electron acceleration layer (14 or 44) made of at least an insulating material (insulating microparticles 15 or resin) is provided between the lower electrode (12) and the surface electrode (33). At least one (lower electrode 12) of the lower electrode (12) and the surface electrode (33) is a stripe-pattern electrode including a plurality of unit electrodes (12*a* to 12*f*) that are regularly arranged. Further, the electron emitting device (30) includes an electrode selecting unit (18) that sequentially selects, from among the plurality of unit electrodes (12*a* to 12*f*), a unit electrode to which a voltage is to be applied.

According to the above-described configuration, dimensions such as the widths of the individual unit electrodes (12*a* to 12*f*) included in the lower electrode (12) may be set independently of the size (area) of the electron emitting device (30). In other words, the area of regions (Ra to Rf) from which electrons are emitted in one cycle may be determined independently of increasing the area of the electron emitting device (30).

Thus, the electron emitting device (30) does not emit a large amount of electrons from a certain region from which electrons are easily emitted. Even if the area of the electron emitting device is increased, electrons of an even distribution may be emitted over a time period corresponding to one cycle. That is, the electron emitting device (30) may emit electrons with high in-plane evenness even if the electron emitting device (30) has a large area.

In an electron emitting device (10 or 40) according to a second aspect of the present disclosure, in the above-described first aspect, both of the lower electrode (12) and a surface electrode (13) may be stripe-pattern electrodes including a plurality of unit electrodes (12*a* to 12*f* and 13*a* to 13*f*) that are regularly arranged. The plurality of unit electrodes (12*a* to 12*f*) included in the lower electrode (12) and the plurality of unit electrodes (13*a* to 13*f*) included in the surface electrode (13) may be disposed so as to cross each other. The electrode selecting unit (18 and 19) may sequentially select, from among the plurality of unit electrodes (12*a* to 12*f*) included in the lower electrode (12), a unit electrode to which a voltage is to be applied, and may sequentially select, from among the plurality of unit electrodes (13*a* to 13*f*) included in the surface electrode (13), a unit electrode to which a voltage is to be applied.

According to the above-described configuration, in the electron emitting device (10), the area of regions (Raa to Rff) from which electrons are emitted in one period may be decreased. Thus, in the electron emitting device (10), in-plane evenness of emitted electrons may be further increased.

In an electron emitting device (30) according to a third aspect of the present disclosure, in the above-described first aspect, the lower electrode (12) may be a stripe-pattern electrode including the plurality of unit electrodes (12*a* to 12*f*) that are regularly arranged, and the surface electrode (33) may be formed of one thin-film electrode that covers the lower electrode (12).

According to the above-described configuration, the lower electrode (12) is a stripe-pattern electrode including the unit electrodes (12*a* to 12*f*), which are arranged in parallel to one another. Accordingly, the unit electrodes (12*a* to 12*f*) may be efficiently (without waste) arranged in the electron emitting device (30). Thus, the limited area of the electron emitting device (30) may be effectively used, and electrons may be emitted from the largest possible region. Since the surface electrode (33) is formed of one thin-film electrode, the electron emitting device (30) has a simple configuration. Thus, the manufacturing process of the electron emitting device 30 may be simplified, and as a result, an increase in manufacturing cost may be suppressed and yields may be increased.

In an electron emitting device (10 or 30) according to a fourth aspect of the present disclosure, in any one of the above-described first to third aspects, the electron acceleration layer (14) may include at least insulating microparticles (15).

The electron acceleration layer (14) including at least the insulating microparticles (15) may be fabricated using, for example, the spin coat method. According to the above-described configuration, the electron acceleration layer (14) having a large area may be manufactured with a high throughput and a low cost, and thus an increase in manufacturing cost of the electron emitting device (10 or 30) may be suppressed.

In an electron emitting device (10 or 30) according to a fifth aspect of the present disclosure, in the above-described fourth aspect, the insulating microparticles (15) may be monodisperse, and may be filled while being arranged.

According to the above-described configuration, in the electron acceleration layer (14), contacts and continuity paths among the insulating microparticles (15) are evenly formed. Thus, in the entire region of the electron acceleration layer (14) in which a voltage is applied to the both ends, electrons may be efficiently transmitted while being trapped. As a result, more ballistic electrons are produced under the surface electrode (13, 33), and a large amount of electrons may be emitted. Accordingly, the electron emission efficiently of the electron emitting device (10 or 30) may be further increased.

In an electron emitting device (10 or 30) according to a sixth aspect of the present disclosure, in the above-described fourth or fifth aspect, the insulating microparticles (15) may include at least one of silicon oxide, aluminum oxide, and titanium oxide.

According to the above-described configuration, because the resistances (insulation performances) of these materials are high, the resistance value of the electron acceleration layer (14) may be easily controlled to be within a certain range.

In an electron emitting device (10 or 30) according to a seventh aspect of the present disclosure, in the above-described fourth or sixth aspect, the insulating microparticles (15) may have an average diameter of 5 to 1000 nm.

According to the above-described configuration, the electron acceleration layer (14) may efficiently let Joule heat escape, the Joule heat being generated when a current flows through the electron emitting device (electron acceleration layer (14)). Accordingly, breakdown of the electron emitting device (10 or 30) caused by heat that is generated during operation may be suppressed. Further, the resistance value of the electron acceleration layer (14) may be easily controlled.

In an electron emitting device (10 or 30) according to an eighth aspect of the present disclosure, in the above-described fourth or seventh aspect, the thickness of the electron acceleration layer (14) may be 8 to 3000 nm.

According to the above-described configuration, the surface of the electron acceleration layer (14) may be flattened, and the resistance value of the electron acceleration layer (14) in the thickness direction may be controlled. The thickness of the electron acceleration layer (14) may be 30 to 1000 nm.

In an electron emitting device (40) according to a ninth aspect of the present disclosure, in any one of the above-described first to third aspects, the electron acceleration layer (44) may be formed of a resin layer containing at least conductive microparticles.

According to the above-described configuration, the thickness of the electron acceleration layer (44) may be made more even. Thus, the in-plane evenness of electrons emitted by the electron emitting device may be further increased.

An electron emitting apparatus (1) according to a tenth aspect of the present disclosure may include the electron emitting device (10, 30, 40) according to any one of the above-described first to ninth aspects and a power supply unit (20) that applies a voltage between the lower electrode (12) and the surface electrode (13, 33).

According to the above-described configuration, electrical continuity may be ensured so that a sufficient in-device current flows, and ballistic electrons may be efficiently and stably emitted from the surface electrode (13, 33).

A charging apparatus (50) according to an eleventh aspect of the present disclosure may include the electron emitting apparatus (1) according to the above-described tenth aspect, and electrons may be emitted from the electron emitting apparatus (1) to charge a photoconductor (photoconductor drum 51).

According to the above-described configuration, the electron emitting device (10, 30, 40) is used for the charging apparatus 50. Accordingly, discharge does not occur even in use in an air atmosphere, and an object to be charged may be stably charged for a long time without producing harmful substances, such as ozone and nitrogen oxide.

An electron beam curing apparatus (60) according to a twelfth aspect of the present disclosure may include the electron emitting apparatus (1) according to the above-described tenth aspect, and may cure a resin (resist 62) by emitting electrons from the electron emitting apparatus (1).

A field electron emitting device according to the related art is a point electron emission source. In contrast, the electron emitting device (10, 30, 40) is a surface electron emission source that emits electrons two-dimensionally. That is, the electron emitting device (10, 30, 40) may emit electrons over a wide region at a time. Thus, the electron beam curing apparatus (60) including the electron emitting device (10, 30, 40) may emit electrons two-dimensionally and cure a wide range of resist at a time. Also, the electron beam curing apparatus (60) enables a maskless process when curing a resist, and an increase in manufacturing cost may be suppressed and the throughput may be increased.

The present disclosure is not limited to the above-described embodiments. Various changes may be implemented within the scope of the claims, and also an embodiment obtained by appropriately combining technical means disclosed in different embodiments is included in the technical scope of the present disclosure. Further, a combination of technical means disclosed in the individual embodiments may form a new technical feature.

An electron emitting device according to an embodiment of the present disclosure may be applied to a charging apparatus of an image forming apparatus, which may be used as an electrophotographic copier, a printer, or a facsimile machine, and may be applied to an electron beam curing apparatus or the like.

The present disclosure contains subject matter related to that disclosed in Japanese Priority Patent Application JP 2013-089819 filed in the Japan Patent Office on Apr. 22, 2013, the entire contents of which are hereby incorporated by reference.

What is claimed is:

1. An electron emitting device comprising:

a lower electrode;

a surface electrode;

an electron acceleration layer between the lower electrode and the surface electrode, the electron acceleration layer being made of at least an insulating material; and an electrode selecting unit, wherein at least one of the lower electrode and the surface electrode is a stripe-pattern electrode including a plurality of unit electrodes that are regularly arranged, the electrode selecting unit sequentially selects, from among the plurality of unit electrodes, a unit electrode to which a voltage is to be applied, a voltage is applied between the lower electrode and the surface electrode to accelerate electrons between the lower electrode and the surface electrode, so that the electrons are emitted from the surface electrode, and the electron acceleration layer is made of a resin material containing only conductive microparticles.

2. The electron emitting device according to claim 1, wherein each of the lower electrode and the surface electrode is a stripe-pattern electrode including a plurality of unit electrodes that are regularly arranged, the plurality of unit electrodes included in the lower electrode and the plurality of unit electrodes included in the surface electrode are arranged so as to cross each other, and the electrode selecting unit sequentially selects, from among the plurality of unit electrodes included in the lower electrode, a unit electrode to which a voltage is to be applied, and sequentially selects, from among the plurality of unit electrodes included in the surface electrode, a unit electrode to which a voltage is to be applied.

3. The electron emitting device according to claim 1, wherein the lower electrode is a stripe-pattern electrode including a plurality of unit electrodes that are regularly arranged, and the surface electrode is formed of one thin-film electrode that covers the lower electrode.

* * * * *